United States Patent [19]

Schmid et al.

[11] 4,364,818

[45] Dec. 21, 1982

[54] CONTROL OF PYRITE ADDITION IN COAL LIQUEFACTION PROCESS

[75] Inventors: Bruce K. Schmid; James E. Junkin, both of Englewood, Colo.

[73] Assignee: The Pittsburg & Midway Coal Mining Co., Englewood, Colo.

[21] Appl. No.: 282,731

[22] Filed: Jul. 15, 1981

[51] Int. Cl.[3] ..... C10G 1/06

[52] U.S. Cl. ..... 208/10

[58] Field of Search ..... 208/10

[56] References Cited

U.S. PATENT DOCUMENTS

| | | | |
|---|---|---|---|
| 4,159,236 | 6/1979 | Schmid | 208/10 |
| 4,159,238 | 6/1979 | Schmid | 208/10 |
| 4,161,440 | 7/1979 | Brunson | 208/10 |
| 4,203,823 | 5/1980 | Carr et al. | 208/10 |
| 4,222,847 | 9/1980 | Carr et al. | 208/8 LE |
| 4,222,848 | 9/1980 | Carr et al. | 208/8 LE |
| 4,227,989 | 10/1980 | Gorbaty et al. | 208/10 X |

OTHER PUBLICATIONS

"Low-Rank Coal Study National Needs for Resource Development"; vol. 1, Executive Summary; Energy Resources Co., Inc.; Walnut Creek, California, 94596, DOE Contract DE-AC18-79PC10066, Pub. Nov. 1978, pp. 1,4,6,8-10,27,31,43,44-46.

"Low-Rank Coal Study National Needs for Resource Development"; Vol. III, Executive Summary; Energy Resources Co., Inc.; Walnut Creek, California 94596, Pub. Nov. 1980; pp. 648-650,678,679,710,711,713 and 715.

*Primary Examiner*—Delbert E. Gantz
*Assistant Examiner*—William G. Wright
*Attorney, Agent, or Firm*—Deane E. Keith; Forrest D. Stine; Alvin E. Ring

[57] ABSTRACT

Pyrite addition to a coal liquefaction process (22, 26) is controlled (118) in inverse proportion to the calcium content of the feed coal to maximize the $C_5$—900° F. (482° C.) liquid yield per unit weight of pyrite added (110). The pyrite addition is controlled in this manner so as to minimize the amount of pyrite used and thus reduce pyrite contribution to the slurry pumping load and disposal problems connected with pyrite produced slag.

15 Claims, 4 Drawing Figures

EFFECT OF PYRITE ADDITION ON TOTAL LIQUID YIELD DURING COAL LIQUEFACTION

EFFECT OF CALCIUM CONTENT ON LIQUID YIELD IMPROVEMENT BY PYRITE

EFFECT OF CALCIUM CONTENT ON LIQUID YIELD IMPROVEMENT BY PYRITE

CONTROL OF PYRITE ADDITION IN COAL LIQUEFACTION PROCESS

The Government of the United States of America has rights in this invention pursuant to Contract No. DE-AC01-19ET14800, awarded by the U.S. Department of Energy to The Pittsburg & Midway Coal Mining Co., a subsidiary of Gulf Oil Corporation.

FIELD OF THE INVENTION

This invention relates to a process for controlling pyrite addition to a coal liquefaction process. More particularly, the invention relates to a process for improving the yield of liquid boiling in the range of $C_5$—900° F. (482° C.) in a coal liquefaction process per unit weight of pyrite added to the feed slurry wherein such addition is made in inverse proportion to the calcium content of the feed coal.

BACKGROUND OF THE INVENTION

The addition of pyrite to a coal liquefaction process to improve conversion of normally solid dissolved coal to liquid coal and gaseous hydrocarbons is described in U.S. Pat. Nos. 4,222,847 and 4,222,848 to N. L. Carr and B. K. Schmid. The patents demonstrate that the addition of increased amounts of pyrite of reduced size to a coal liquefaction process which employs recycle of a product slurry correspondingly increases the yield of $C_5$—900° F. (482° C.) liquid, while decreasing the yield of normally solid dissolved coal 900° F.+ (482° C.+) product.

Although pyrite is a useful catalytic material in such systems, the addition of pyrite to the feed slurry adds to the pumpability problem normally associated with pumping slurries. Moreover, pyrite is a potential pollutant since it contains sulfur and can cause a disposal problem as it is withdrawn from the system as slag in potentially large quantities. Thus, it would be highly desirable to minimize the amount of pyrite added to a coal liquefaction process, particularly when the process will be conducted on a large scale basis, so as to reduce the total solids to be pumped and to be disposed of.

SUMMARY OF THE INVENTION

It has now been discovered that the effectiveness of pyrite as a catalyst for improving the yield of liquid product boiling in the range $C_5$—900° F. (482° C.) in a coal liquefaction process is in direct proportion to the amount of calcium present in the feed coal. Surprisingly, it has been found that so-called "high calcium-containing coals" are much more amenable to conversion to distillate liquid in the presence of pyrite than are "low calcium-containing coals". Moreover, it was unexpected to discover that the catalytic effect of pyrite is substantially particle size independent when treating high calcium-containing feed coal. While some pulverization is desirable, a costly pulverization step to divide the pyrite into very small particles is unnecessary. This discovery correlating improvement in conversion of coal to liquid in proportion to calcium content enables the improvement and control of $C_5$—900° F. (482° C.) liquid yield by utilizing the minimum amount of pyrite necessary to achieve the desired conversion based upon the calcium content of the particular coal undergoing liquefaction. By minimizing the amount of pyrite added, the total solids content of the system is reduced, thereby reducing the amount of solids to be pumped and the quantity of slag withdrawn from a combined gasifier in the system.

According to the present invention, a process is provided for controlling pyrite addition and yield of total liquid product obtained in a coal liquefaction process, which process comprises passing hydrogen and a feed slurry comprising high calcium feed coal and a distillate solvent to a coal liquefaction zone, and adding pyrite to the feed slurry in inverse proportion to the calcium content of the feed coal. According to a preferred embodiment of the present invention the amount of calcium in the feed coal is determined and the amount of pyrite added is controlled in inverse proportion to the calcium content of the feed coal. According to another preferred embodiment the feed slurry to the process comprises recycle distillate solvent, recycle normally solid dissolved coal and recycle mineral residue along with the high calcium feed coal.

Accordingly, by injecting the minimum amount of extraneous pyrite, i.e., pyrite other than that present in the feed coal, to the feed slurry necessary to achieve desired conversion of coal to $C_5$—900° F. (482° C.) liquid, the total amount of pyrite resulting in disposable slag is reduced. A relatively high calcium-containing feed coal requires less pyrite to achieve maximum conversion to total liquid than does a lower calcium-containing feed coal. Thus, the quantity of injected pyrite can be proportionally reduced. Likewise, it was found that a relatively small quantity of iron pyrite-containing material need be added to a high calcium-containing feed coal to provide exceptional improvement in $C_5$—900° F. (482° C.) liquid yield comparable to yields typical of high sulfur, more reactive coals.

Since every batch of coal is different in nature regardless of its general source, the calcium content of the coal fed to a coal liquefaction process will vary. Thus, the process of the present invention provides a means for determining and supplying the minimum quantity of pyrite catalyst to the feed slurry on an ongoing basis to achieve the desired degree of conversion.

DESCRIPTION OF THE PREFERRED EMBODIMENTS

Figure 1:
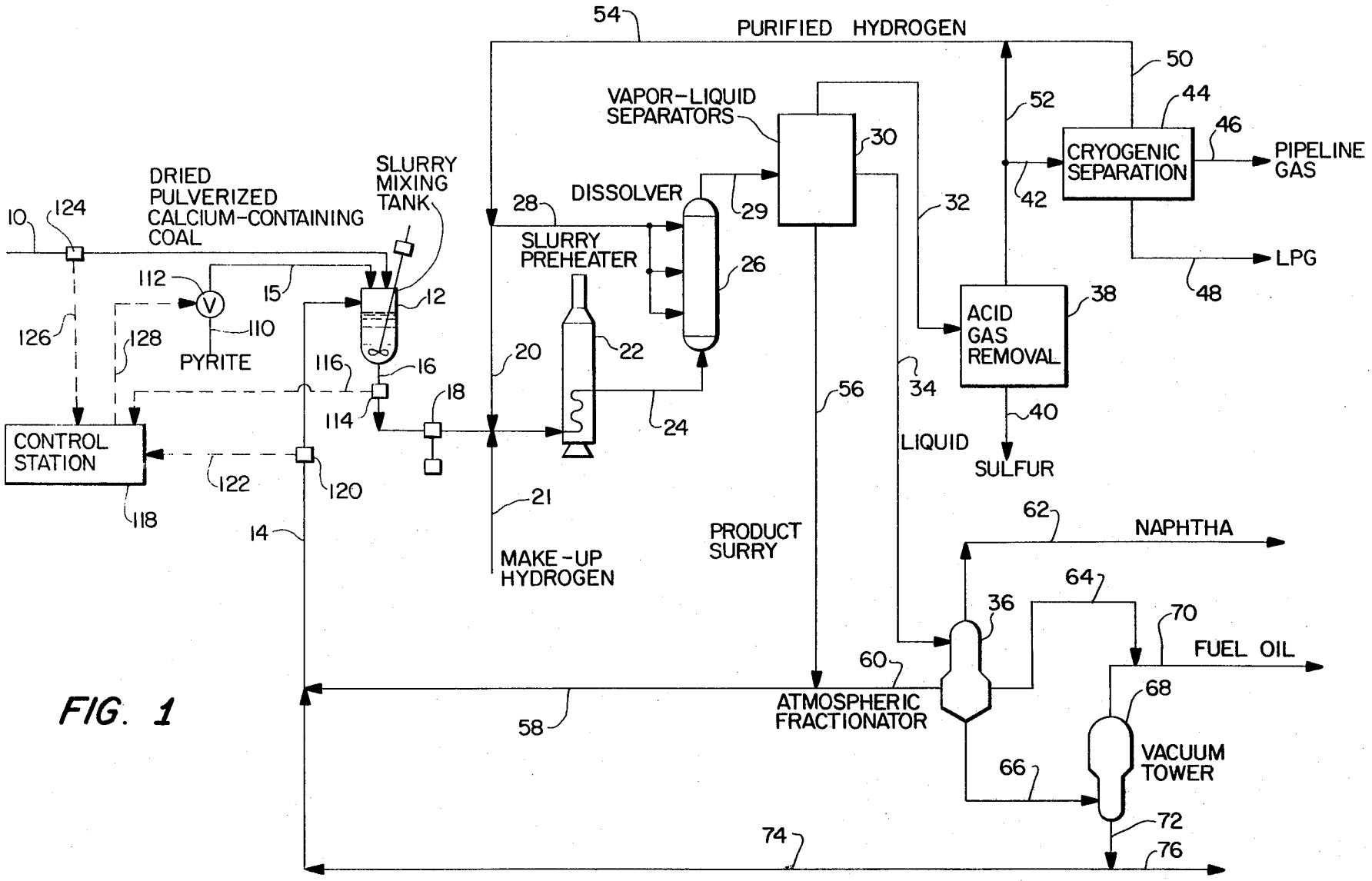
FIG. 1 is a schematic flow diagram of a process for controlling pyrite injection to the feed slurry.

As shown in the process set forth in FIG. 1 of the drawings, dried, pulverized calcium-containing raw coal is passed through line 10 to slurry mixing tank 12 wherein it is mixed with recycle slurry containing recycle normally solid dissolved coal, recycle mineral residue and recycle distillate solvent boiling in the range of between about 350° F. (177° C.) and about 900° F. (482° C.) flowing in line 14. The concentration of feed coal in the recycle slurry can be in the range of 20 to 40 weight percent, preferably 25 to 35 weight percent. "Normally solid dissolved coal" refers to the 900° F.+ (482° C.+) dissolved coal which is normally solid at room temperature. "Mineral residue" refers to the combination of all of the inorganic mineral matter and all of the undissolved organic material (UOM) of the feed coal. The "mineral residue" contains all of the iron in the inorganic mineral matter (ash) portion thereof. Pyrite is injected in vessel 12 by means of line 15 as a catalytic additive. The quantity of pyrite added through line 15 is, for example, between about 1 to about 10 weight percent, preferably between about 1 or 2 and about 5 weight percent pyrite based upon the weight of MF (moisture free) feed coal.

The amount of calcium in the feed coal will vary depending upon the source and nature of the coal. As used in this application, the term "high calcium" feed coal are those coals containing greater than 0.8 or 1.5 weight percent calcium (expressed as CaO), for example, between about 1.0 to about 3 weight percent calcium based upon MF coal. A "low calcium" coal as used herein includes coal containing less than about 0.6 or 0.5 weight percent calcium (expressed as CaO), for example, 0.25 weight percent calcium based upon MF coal. Mineral constituents of coal are commonly determined by analysis of the ash resulting from combustion of a coal sample. The analysis of coal ash for these elements has been standardized by the D5 Committee of ASTM. Regardless of the original state in the coal sample, all elements are in the oxide form in the ash and are reported as oxides. For purposes of discussion herein, all references to coal calcium content refer to the above ash analysis for calcium oxide (CaO) and are expressed as weight percent calcium oxide.

Control of the amount of pyrite added to the feed slurry in proportion to the calcium content of the feed coal can be accomplished by any suitable means. The amounts of calcium and pyrite in the feed coal flowing in line 10 can be monitored at test station 124 and the information supplied by line 126 to control station 118.

In response to information received from test station 124, the control station 118 regulates the amount of pyrite added to the slurry mixing tank 12 from line 15 by regulating the operation of flow control device, for example valve 112 which can be controlled as graphically illustrated by line 128. In this way, the concentration of pyrite added to the feed slurry is controlled in response to the concentration of calcium in the feed coal.

By controlling the quantity of pyrite added to the feed slurry based upon the calcium content of the coal, the maximum liquid yield per unit weight of pyrite can be achieved.

The calcium content of the feed coal may be measured as frequently as desired, and thus, monitoring can be conducted on a repetitive basis, whether periodic or not. For example, the calcium content of the feed coal can be monitored by testing a sample according to the Standard Method formalized by the D5 committee of ASTM described in "Standard Methods of Analysis of Coal and Coke Ash", 1976 *Annual Book of ASTM Standards,* part 26.

The expression "pyrite" as used herein is the chemical compound iron sulfide ($FeS_2$) and can be obtained from water washing raw coal. The pyrite introduced by means of line 15 can be in pulverized form having an average particle diameter greater than 15 microns, for example, between about 20 or 30 to about 100 microns. The particle size of the pyrite has substantially no effect upon conversion of the "high calcium" feed coal to liquid.

The pyrite added, as well as any pyrite inherently contained in the feed coal, is converted during the process into ferrous sulfide (FeS). Any measurement of iron or ferrous sulfide in the recycle slurry in line 14 will detect material from both the original feed coal and from the added pyrite. Further control of the pyrite addition rate may be accomplished by measuring the iron content of the recycle slurry in line 14 at test station 120 and transmitting the resulting information via line 126 to control station 118 to adjust the quantity of pyrite added according to the iron content in the recycle slurry. For example, if the iron content of the recycle slurry tends to increase because of the variations within the process, the quantity of pyrite added can be decreased slightly below that which would otherwise be used based on the calcium content of the coal.

Similarly, if the iron content in the recycle slurry tends to decrease because of variations in the process, the quantity of added pyrite can be increased somewhat above that which would otherwise be required based on the calcium content of the coal.

The feed slurry in line 16 is pumped by means of reciprocating pump 18 and admixed with recycle hydrogen entering through line 20 and with make-up hydrogen entering through line 21 prior to passage through tubular preheater furnace 22 from which it is discharged through line 24 to dissolver 26.

The temperature of the reactants at the outlet of preheater 22 is about 700° F. (371° C.) to 760° F. (404° C.). At this temperature the coal is partially dissolved in the recycle solvent, and the exothermic hydrogenation and hydrocracking reactions are just beginning. Whereas the temperature gradually increases along the length of the preheater tube, dissolver 26 is at a generally uniform temperature throughout and the heat generated by the hydrocracking reactions in the dissolver raises the temperature of the reactants to the reaction temperature. Hydrogen quench passing through line 28 is injected into the dissolver at various points to control the reaction temperature and alleviate the impact of the exothermic reactions.

The conditions in the dissolver include a temperature in the range of 750° F. to 900° F. (399° C. to 482° C.), preferably 820° F. to 870° F. (438° C. to 466° C.) and a residence time of 0.1 to 4.0 hours, preferably 0.2 to 2 hours. The total pressure is in the range of 1,000 to 3,000 psi and is preferably 1,500 to 2,500 psi (70 to 210 $kg/cm^2$, preferably 105 to 175 $kg/cm^2$). The ratio of hydrogen to feed coal can be, for example, about 10,000 to about 80,000 SCF/ton (0.31–2.48 $M^3/kg$), preferably from 20,000 to 50,000 SCF/ton, (0.62–1.55 $M^3/kg$).

The dissolver effluent passes through line 29 to vapor-liquid separator system 30. Vapor-liquid separation system 30, consisting of a series of heat exchangers and vapor-liquid separators separates the dissolver effluent into a non-condensed gas stream 32, a condensed light liquid distillate in line 34 and a product slurry in line 56. The condensed light liquid distillate from the separators passes through line 34 to atmospheric fractionator 36. The non-condensed gas in line 32 comprises unreacted hydrogen, methane and other light hydrocarbons, along with $H_2S$ and $CO_2$, and is passed to acid gas removal unit 38 for removal of $H_2S$ and $CO_2$. The hydrogen sulfide recovered is converted to elemental sulfur which is removed from the process through line 40. A portion of the purified gas is passed through line 42 for further processing in cryogenic unit 44 for removal of much of the methane and ethane as pipeline gas which passes through line 46 and for the removal of propane and butane as LPG which passes through line 48. The purified hydrogen in line 50 is blended with the remaining gas from the acid gas treating step in line 52 and comprises the recycle hydrogen for the process.

The product slurry from vapor-liquid separators 30 passes through line 56 and comprises liquid solvent, normally solid dissolved coal and catalytic mineral residue. Stream 56 is split into two major streams, 58 and 60, which have the same composition as line 56. The non-recycled portion of this slurry passes through line 60 to atmospheric fractionator 36 for separation of the major products of the process.

In fractionator 36, the slurry product is distilled at atmospheric pressure to remove an overhead naphtha stream through line 62, a 350° F. (177° C.) to 600° F. (316° C.) light distillate stream through line 64 and a bottoms stream through line 66. The bottoms stream in line 66 passes to vacuum distillation tower 68. The temperature of the feed to the fractionation system is normally maintained at a sufficiently high level that no additional preheating is needed, other than for start-up operations. A heavy distillate stream comprising 600° F. (316° C.) to 900° F. (482° C.) material is withdrawn from the vacuum tower through line 70. The combination of the light and heavy distillates in lines 64 and 70 makes up the major fuel oil product of the process.

The bottoms from vacuum tower 68, consisting of all the normally solid dissolved coal, undissolved organic matter and mineral matter of the process, but essentially without any distillate liquid or hydrocarbon gases, may be discharged by means of line 72 to line 76 for further processing as desired. For example, each stream may be passed to a partial oxidation gasifier to produce hydrogen for the process in the manner described in U.S. Pat. No. 4,222,847 to N. L. Carr and B. K. Schmid, the disclosure of which is hereby incorporated by reference. Alternatively the bottoms from line 72 may be passed via lines 74 and 14 to slurry mixing tank 12.

The following examples are not intended to limit the invention, but rather are presented for purposes of illustration. All percentages are by weight unless otherwise indicated.

EXAMPLE I

Tests were performed on a high calcium content coal (Kaiparowits) and a low calcium content coal sample (Blacksville No. 2). In each case, the test was conducted at a temperature of 450° C., a total pressure of 2250 psig (157 kg/cm$^2$), a hydrogen rate of 4 weight percent based upon the total weight of the feed slurry, a residence time of 1.0 hour using a feed slurry containing 30 weight percent MF coal with the remainder of the feed slurry comprising product slurry recycled from the process.

The results of these tests are shown in Table I.

TABLE I

| Test No. | Coal | Calcium (CaO) Content Amount (Wt. % of Feed Coal) | Pyrite Material Added: Amount (Wt. % of MF Feed Coal) | Pyrite Material Added: Average Particle Size (Microns) | $C_5$ - 900° F. (482° C.) Liquid Yield Wt. (% MAF Coal) | $C_5$ - 900° F. (482° C.) Liquid Yield Wt. % Increase Per Wt. % Pyrite Added |
|---|---|---|---|---|---|---|
| 1a | Kaiparowits | 1.87 | 0 | — | 32.1 | — |
| 1b | Kaiparowits | " | 5.2 | 1 | 47.9 | 3.04 |
| 2a | Blacksville | 0.25 | 0 | — | 40.2 | — |
| 2b | Blacksville | " | 5.2 | 1 | 42.6 | 0.46 |

The data of Table I show that the $C_5$—900° F. (482° C.) liquid yield for the low calcium content (Blacksville No. 2) coal increased only 2.4 weight percent when 5.2 weight percent pyrite was added in Test 2b as compared with Test 2a in which no additional pyrite was injected. On the other hand, the $C_5$—900° F. (482° C.) liquid produced in Test 1a increased by 15.8 weight percent over Test 1b when 5.2 weight percent pyrite was added. Thus, the high calcium feed coal produced a $C_5$—900° F. (482° C.) yield increase of 3.04 weight percent based on MAF coal for each weight percent of pyrite added, while the low calcium content coal produced only a $C_5$—900° F. (482° C.) yield increase of 0.46 weight percent based on MAF coal per unit weight of pyrite added.

EXAMPLE II

Tests were performed using a number of feed coals having high and low calcium content to show the interactive effects of the calcium and added pyrite in a coal liquefaction process. The conditions and results of Tests 3a–12b are presented in Table II. Tests 3a–8b were conducted under a total pressure of 2250 psig (157 kg/cm$^2$) and tests 9a–12b were conducted under a total pressure of 1800 psig (126 kg/cm$^2$) using pure hydrogen at a nominal rate of 50,000 SCF/ton of feed coal with a nominal reactor residence time of one hour and a coal concentration of 30 weight percent. Other process conditions are set forth in Table II. In all cases the feed coal and added pyrite were mixed with recycle slurry from the process and the recycle slurry flow was adjusted in a consistent manner to maintain solvent balance and steady state conditions.

TABLE II

| Test No. | Coal | Higher Heating Value of Coal (BTU/lb M.F) | Calcium (CaO) Content (Wt. % of Feed Coal) | Temp. (°C.) | Pyrite Material Added Based on MF Coal: Amount (Wt. % of Feed Coal) | Pyrite Material Added Based on MF Coal: Average Particle Size (Microns) | $C_5$ - 900° F. (482° C.) Liquid Yield (Wt. % MAF Coal) | $C_5$ - 900° F. (482° C.) Liquid Yield Increase Per Wt. Pyrite Added: Actual (Wt. % MAF Coal) | $C_5$ - 900° F. (482° C.) Liquid Yield Increase Per Wt. Pyrite Added: Predicted (Wt. % MAF Coal) |
|---|---|---|---|---|---|---|---|---|---|
| 3a | Ayrshire | 12879 | 1.71 | 450 | 0 | — | 31.4 | — | — |

TABLE II-continued

| Test No. | Coal | Higher Heating Value of Coal (BTU/lb M.F) | Calcium (CaO) Content (Wt. % of Feed Coal) | Temp. (°C.) | Pyrite Material Added Based on MF Coal: Amount (Wt. % of Feed Coal) | Pyrite Material Added Based on MF Coal: Average Particle Size (Microns) | $C_5$ - 900° F. (482° C.) Liquid Yield (Wt. % MAF Coal) | $C_5$ - 900° F. (482° C.) Liquid Yield Increase Per Wt. Pyrite Added: Actual (Wt. % MAF Coal) | $C_5$ - 900° F. (482° C.) Liquid Yield Increase Per Wt. Pyrite Added: Predicted (Wt. % MAF Coal) |
|---|---|---|---|---|---|---|---|---|---|
| 3b | " | " | " | 450 | 2.67 | 1 | 49.9 | 6.93 | 4.42 |
| 4a | Belle Ayr | 11890 | 1.76 | 450 | 0 | — | 37.1 | — | — |
| 4b | " | " | " | 450 | 2.15 | 1 | 53.9 | 7.81 | 5.02 |
| 5a | Blacksville | 14279 | 0.25 | 454.6 | 0 | — | 40.1 | — | — |
| 5b | " | " | " | 454.4 | 2.4 | 75 | 43.6 | 1.45 | 2.25 |
| 6a | " | " | " | 454.6 | 0 | — | 40.1 | — | — |
| 6b | " | " | " | 454.2 | 6.1 | 75 | 47.7 | 1.24 | 2.33 |
| 7a | Energy | 12258 | 0.50 | 450 | 3.14 | 65 | 36.9 | — | — |
| 7b | " | " | " | 450 | 6.23 | 65 | 44.5 | 2.46 | 2.98 |
| 8a | Kaiparowits | 12339 | 1.87 | 450 | 0 | — | 32.1 | — | — |
| 8b | " | " | " | 450 | 3.14 | 65 | 47.2 | 4.81 | 3.34 |
| 9a | Loveridge | 13958 | 0.42 | 456 | 0 | — | 33.4 | — | — |
| 9b | " | " | " | 455 | 5.0 | 1 | 46.6 | 2.64 | 4.30 |
| 10a | " | " | " | 456 | 0 | — | 33.4 | — | — |
| 10b | " | " | " | 457 | 5.0 | 1 | 42.3 | 1.78 | 3.46 |
| 11a | Powhatan #5 | 12654 | 0.29 | 455 | 0 | — | 41.1 | — | — |
| 11b | " | " | " | 455 | 5.0 | 1 | 42.6 | 0.30 | 3.16 |
| 12a | " | " | " | 455 | 0 | — | 41.1 | — | — |
| 12b | " | " | " | 455 | 5.0 | 1 | 44.4 | 0.66 | 3.50 |

The data of Table II show that for the higher calcium content coals of Tests 3a–4b and 8a–8b, there is a generally greater improvement in $C_5$—900° F. (482° C.) liquid yield in response to pyrite addition as compared with the generally lower calcium content feed coals.

The effect of pyrite addition of $C_5$—900° F. (482° C.) liquid yield during coal liquefaction is graphically illustrated in FIG. 2 wherein the increase in liquid yield based upon MAF (moisture and ash free) feed coal is plotted versus the weight percent pyrite added as $FeS_2$ based on MF (moisture free) coal.

Figure 2:
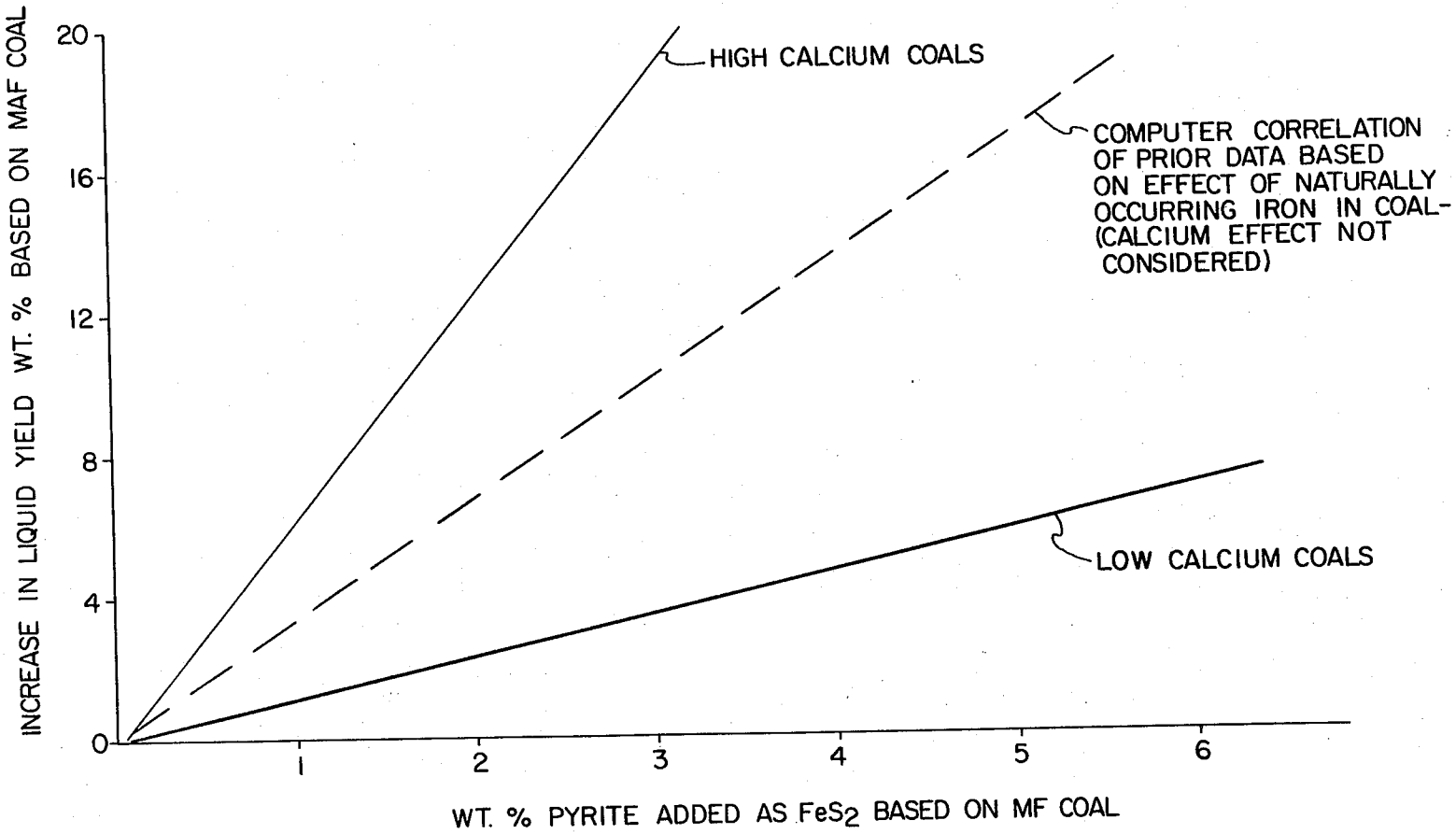
FIG. 2 graphically illustrates the unpredictably high increase in $C_5$—900° F. (482° C.) liquid yield per unit of pyrite added to high calcium feed coal as compared with low calcium feed coal.

The two solid lines of FIG. 2 show the effect of added pyrite upon liquid yield improvement for the low and high calcium coal groups, respectively. The dashed line resulted from a computer correlation from many prior coal liquefaction experiments. Yields were correlated as a function of reactor conditions and selected coal properties which included iron and pyrite sulfur content but not calcium content. The dashed line represents the effect on calculated liquid yields which would be obtained if the pyrite added had the same effect as pyrite actually contained in the feed coal.

As seen in FIG. 2, the beneficial effect of added pyrite on low calcium coals is significantly less than would be expected as seen by comparing the dashed line with the low calcium coal solid line. For high calcium coals however, the beneficial effect is significantly greater than would normally be expected as indicated by comparing the dashed line with the high calcium solid line. The extraordinarily beneficial effect of adding pyrite to high calcium coals is believed to be a result of a catalytic interaction between the added pyrite and the calcium in the feed coal.

FIG. 2 also shows that a given increase in liquid yield can be obtained at a much lower level of added pyrites using high calcium coal. For example, when using low calcium coal, an increase in liquid yield of 6% requires the addition of 5.2% pyrite compared to a requirement of only about 1% added pyrite for high calcium coals. This effect is also illustrated by a comparison of test numbers 8a and 8b compared with test numbers 9a and 9b. Here an increase of about 14% requires the addition of 5% pyrite with low calcium coal and only about 3% pyrite with high calcium coal (Kaiparowits).

The advantage of the discovery of this effect is that measuring the calcium content of the feed coal makes it possible to minimize the addition of pyrite to achieve a given increase in liquid yield, or to maximize the liquid yield by adding a larger quantity of pyrite. The total quantity of pyrite which can be added is limited by the fact that it adds to the total solids content in the system. The total solids content in the system is in turn limited by pumpability constraints in the slurry feed system and in the vacuum tower bottoms stream.

Figure 3:
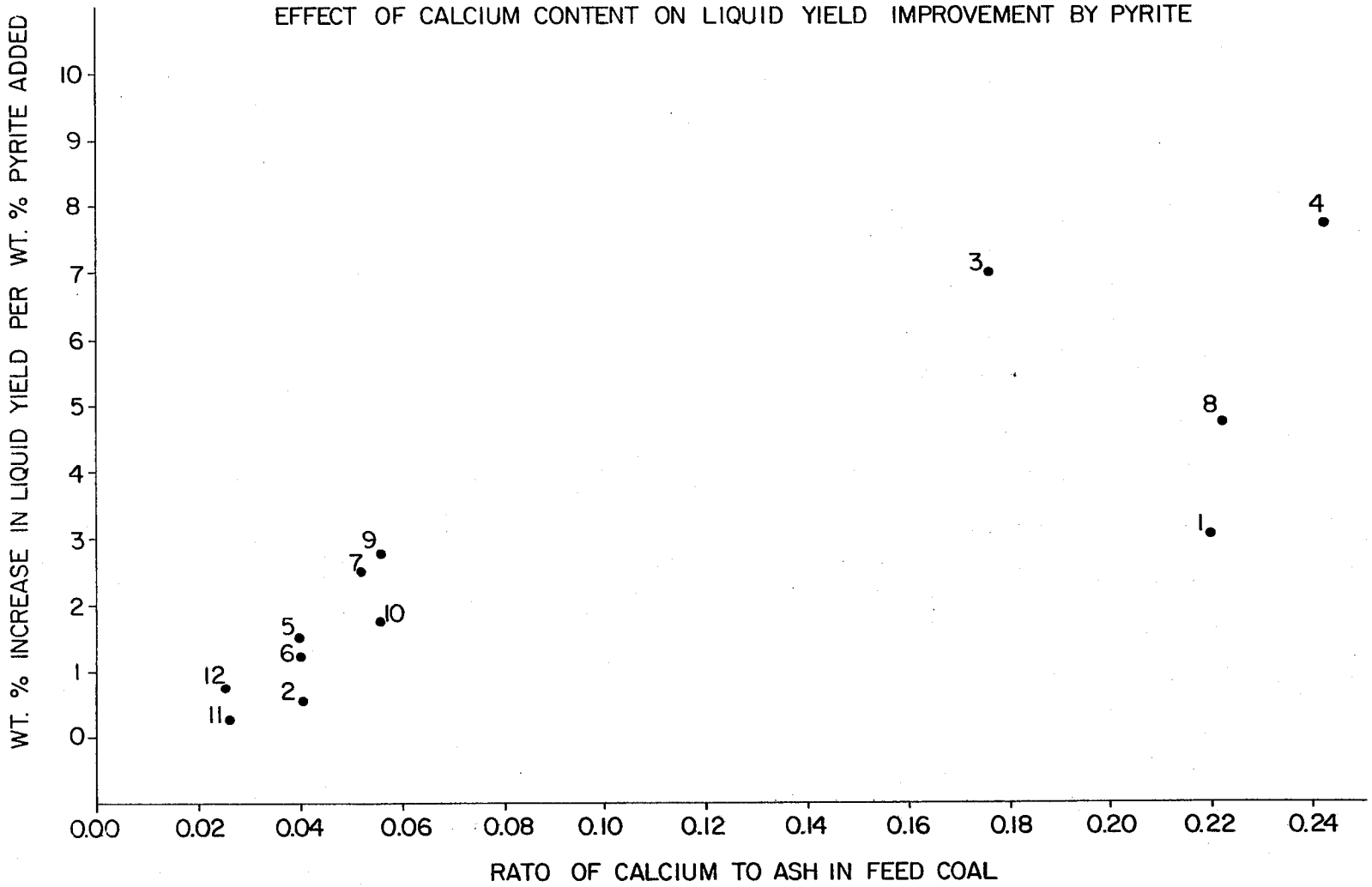
FIGS. 3 and 4 graphically illustrate the $C_5$—900° F. (482° C.) liquid yield improvement per weight percent pyrite added versus the calcium/ash content of the feed coal for high calcium and low calcium feed coal, and as a function of particle size, respectively.

The improvement in $C_5$—900° F. (482° C.) liquid yield per weight percent pyrite added for the various coals is graphically illustrated in FIG. 3 wherein $C_5$—900° F. (482° C.) liquid yield improvement is plotted versus the ratio of calcium content to ash content in the feed coal. The data upon which FIG. 3 is based is set forth in Tables I and II. The numbers in FIG. 3 refer to the test numbers of Tables I and II. FIG. 3 shows that the higher calcium-containing coals produced a greater improvement in liquid yield per unit of added pyrite than did the lower calcium content coals. Thus, point 3 on FIG. 3 represents the $C_5$—900° F. (482° C.) liquid yield increase per unit weight percent pyrite added for Tests 3a and 3b and shows that a 6.93 percent increase in liquid yield was obtained for a 1 percent addition of pyrite. Likewise, FIG. 3 shows that for Tests 4a and 4b (point 4) a 7.81 percent increase in $C_5$—900° F. (482° C.) liquid yield was obtained for each percent of added pyrite for the high calcium coal tested.

FIG. 3 further shows that the lower calcium content coals tested had a much lower yield improvement of $C_5$—900° F. (482° C.) liquid per unit weight of pyrite. The data in Table II further show the $C_5$—900° F. (482° C.) liquid yield increase per weight percent pyrite added predicted by the aforesaid mathematical correlation using model parameters including temperature, pressure, residence time, recycle ash, coal feed concentration and feed pyrite concentration based upon numerous actual tests. It is seen that in each case the actual increase in $C_5$—900° F. (482° C.) liquid obtained for the high calcium content coals is more than the predicted increase, and also greater than the actual data obtained for the low calcium content coals, thus indicating the unpredictable correlation between calcium content of feed coal and $C_5$—900° F. (482° C.) liquid yield improvement caused by pyrite.

Figure 4:
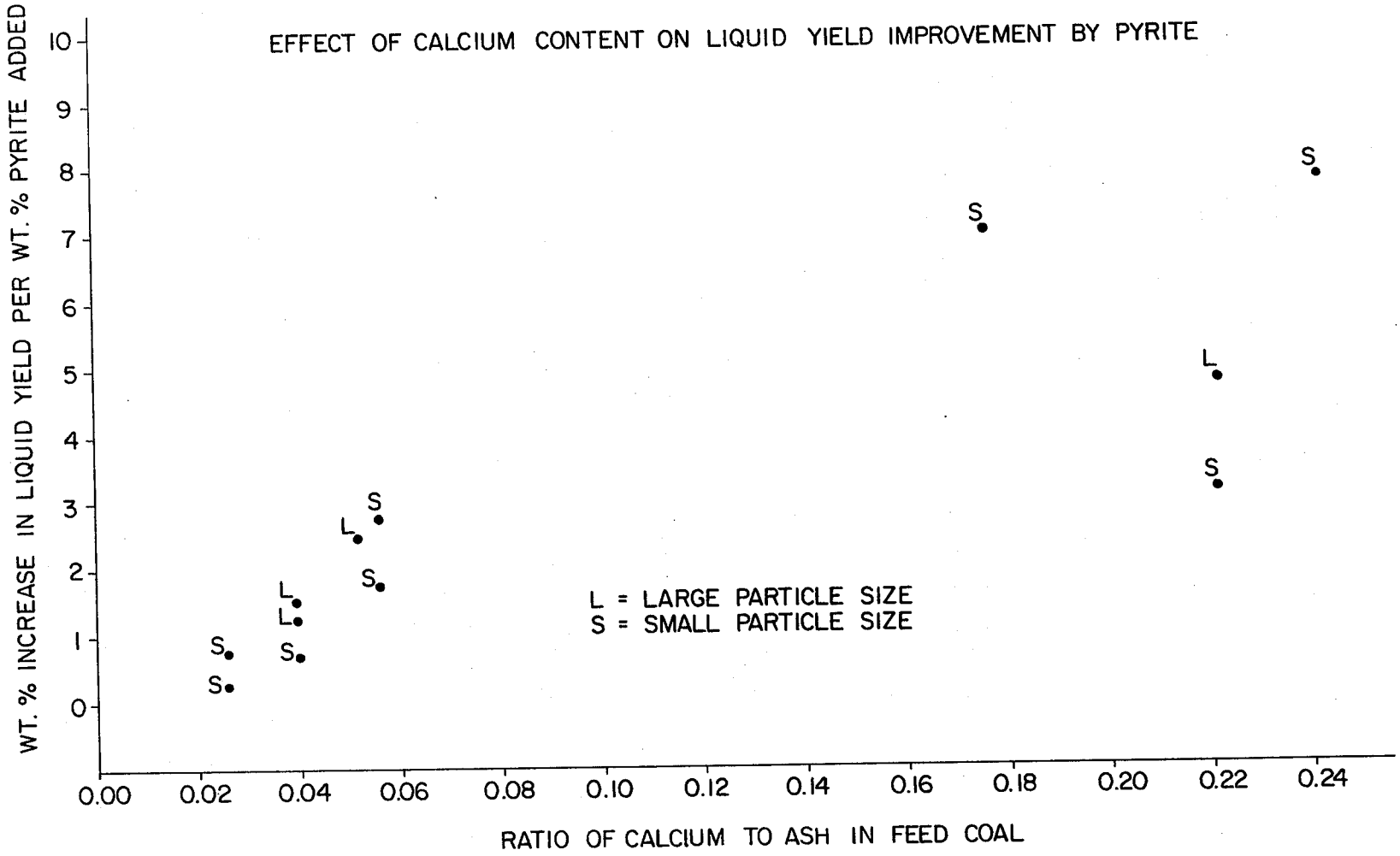

The data of Tables I and II were replotted in FIG. 4 to show the effect of particle size of added pyrite. The tests which were conducted with large size pyrite catalyst are denoted by "L" and those using finely divided pyrite catalyst are depicted by "S". This shows that particle size does not appear to have a significant effect when compared to the effect of calcium, and that the process of this invention is substantially independent of particle size.

EXAMPLE III

Tests were performed using various feed coals having high and low calcium content to show the interactive effects of calcium and added pyrite in a coal liquefaction process without benefit of slurry recycle. The conditions and results of Tests 13a–20 b are presented in Table III. In all cases the feed coal and added pyrite were mixed with recycle distillate liquid in a manner to maintain solvent balance and steady state conditions.

TABLE III

| Test No. | Coal | Calcium (CaO) Content (Wt. % of Feed Coal Ash) | Temp. (°C.) | Total Press. (psig) | Residence Time (min.) | Hydrogen Feed Rate (Wt. % Based on Feed Slurry) | Pyrite Material Added Based on MF Coal: Amount (Wt. % of Feed Coal) | Pyrite Material Added Based on MF Coal: Average Particle Size (Microns) | $C_5$-900° F. (482° C.) Liquid Yield (Wt. % MAF Coal) | $C_5$ - 900° F. (482° C.) Liquid Yield Increased Per Wt. % Pyrite Added (Wt. % MAF Coal) |
|---|---|---|---|---|---|---|---|---|---|---|
| 13a | Ayrshire | 17.6 | 449 | 2250 | 61.8 | 4.1 | 0 | — | 23.1 | — |
| 13b | Ayrshire | 17.6 | 449 | 2250 | 61.8 | 4.13 | 2.05 | 1 | 28.5 | 2.63 |
| 14a | Belle Ayr | 24.1 | 450 | 1500 | 31.2 | 1.92 | 0 | — | −9.7 | — |
| 14b | Belle Ayr | 24.1 | 450 | 1500 | 30.9 | 1.91 | 1.67 | 1 | 12.3 | 13.17 |
| 15a | Blacksville | 3.9 | 451 | 1900 | 26.6 | 3.43 | 0 | — | 18.8 | — |
| 15b | Blacksville | 3.9 | 450 | 1900 | 26.7 | 3.45 | 2.4 | 75 | 18.9 | .04 |
| 16a | Blacksville | 3.9 | 451 | 1900 | 26.6 | 3.43 | 0 | — | 18.8 | — |
| 16b | Blacksville | 3.9 | 450 | 1900 | 26.7 | 3.45 | 6.1 | 75 | 19.5 | .21 |
| 17a | Blacksville | 3.9 | 448 | 1900 | 26.1 | 3.50 | 0 | — | 17.2 | — |
| 17b | Blacksville | 3.9 | 448 | 1900 | 26.6 | 3.56 | 6.1 | 1 | 24.5 | 1.20 |
| 18a | Energy | 5.2 | 450 | 2250 | 61.8 | 4.08 | 0 | — | 14.8 | — |
| 18b | Energy | 5.2 | 450 | 2250 | 61.8 | 4.08 | 4.81 | 65 | 22.9 | 1.68 |
| 19a | Kaiparowits | 22.2 | 450 | 2250 | 60.6 | 4.12 | 0 | — | 10.3 | — |
| 19b | Kaiparowits | 22.2 | 451 | 2250 | 60.6 | 4.06 | 2.4 | 65 | 21.2 | 4.54 |
| 20a | Loveridge | 5.7 | 447 | 1900 | 26.1 | 3.50 | 0 | — | 16.9 | — |
| 20b | Loveridge | 5.7 | 448 | 1900 | 26.2 | 3.51 | 6.1 | 1 | 26.5 | 1.57 |

The data of Table III show that the improvement in $C_5$—900' F. (482° C.) liquid yield for the higher calcium content feed coals is generally greater in response to pyrite addition as compared with the lower calcium content feed coals.

What is claimed is:

1. A coal liquefaction process for increasing the amount of liquid product boiling in the range $C_5$—900° F. (482° C.), which comprises passing hydrogen and a feed slurry comprising a high calcium feed coal and a distillate solvent to a coal liquefaction zone, and adding pyrite to said feed slurry in inverse proportion to the calcium content of said feed coal.

2. The process of claim 1 wherein said feed coal contains from 1.0 to about 3 weight percent calcium based upon MF coal.

3. The process of claim 2 wherein said feed coal contains between about 1.5 to about 3 weight percent calcium based upon MF coal.

4. The process of claim 1 wherein the pyrite added to said feed slurry is between about 1 to about 10 weight percent based upon MF feed coal.

5. The process of claim 4 wherein the pyrite added to said feed slurry is between about 1 to about 5 weight percent pyrite based upon MF feed coal.

6. The process of claim 4 wherein said pyrite added to said feed slurry is between about 2 to about 5 weight percent based upon MF feed coal.

7. The process of claim 1 wherein said pyrite added to said feed slurry has an average particle diameter of between about 20 and about 100 microns.

8. The process of claim 1 wherein said feed slurry additionally comprises recycle slurry comprising recycle normally solid dissolved coal and recycle mineral residue.

9. The process of claim 8 wherein the amount of pyrite added to said feed slurry is controlled by monitoring the calcium content of said feed coal and the iron content of said recycle slurry stream and adding pyrite in response to the concentrations of calcium and iron determined.

10. The process of claim 1 wherein said pyrite is pulverized pyrite obtained from water washing of raw coal.

11. The process of claim 1 wherein the amount of pyrite added to the feed slurry is less than required to achieve the same $C_5$—900° F. (482° C.) liquid yield from a feed coal containing less than 0.6 weight percent calcium.

12. A coal liquefaction process for producing a distillate liquid product which comprises passing hydrogen and a feed slurry comprising a calcium-containing feed coal containing at least 0.8 weight percent calcium based upon MF coal, recycle normally solid dissolved coal, recycle mineral residue and a distillate solvent to a coal liquefaction zone, measuring the calcium content of the ash of said feed coal and controlling the quantity of pyrite added to said feed slurry at a level determined by the concentration of calcium in said feed coal and in inverse proportion to said calcium content of said feed coal, reacting said slurry in a reaction zone at a temperature in the range of between about 399° C. and about 482° C. to dissolve said coal to form distillate liquid and normally solid dissolved coal, separating said reaction effluent into fractions, a first fraction comprising distillate boiling range liquid and a second fraction comprising normally solid dissolved coal and mineral residue, and recycling at least a portion of said distillate boiling range liquid, normally solid dissolved coal and mineral residue for mixing with said feed coal.

13. The process of claim 12 wherein the iron content of said recycle mineral residue is monitored and such information used to control the addition of said pyrite to said feed slurry.

14. The process of claim 12 wherein said feed coal contains from 1.0 to about 3 weight percent calcium based on MF feed coal.

15. The process of claim 12 wherein the pyrite added to said feed slurry is between about 1 to about 10 weight percent based upon MF feed coal.

* * * * *